US008740031B2

(12) United States Patent
Lin

(10) Patent No.: US 8,740,031 B2
(45) Date of Patent: Jun. 3, 2014

(54) TRIGGER STRUCTURE FOR SWITCHING ONE SHOOT MODE OR REPEAT SHOOT MODE

(75) Inventor: Tien-Fu Lin, Taichung (TW)

(73) Assignee: Apach Industrial Co., Ltd., Taichung (TW)

( * ) Notice: Subject to any disclaimer, the term of this patent is extended or adjusted under 35 U.S.C. 154(b) by 425 days.

(21) Appl. No.: 13/323,826

(22) Filed: Dec. 13, 2011

(65) Prior Publication Data

US 2013/0146637 A1 Jun. 13, 2013

(51) Int. Cl.
*B27F 7/00* (2006.01)

(52) U.S. Cl.
USPC ..... 227/8; 227/130; 227/142; 227/2

(58) Field of Classification Search
CPC ..... B25C 1/043; B25C 1/143; B25C 1/008; B25C 1/046
USPC ..... 227/8, 130, 142, 120, 2; 173/170
See application file for complete search history.

(56) References Cited

U.S. PATENT DOCUMENTS

2002/0130154 A1* 9/2002 Wolfberg ..... 227/8
2013/0062390 A1* 3/2013 Yeh ..... 227/8

* cited by examiner

*Primary Examiner* — Stephen F Gerrity
*Assistant Examiner* — Joy N Sanders

(57) ABSTRACT

A trigger structure for switching one shoot mode or repeat shoot mode includes a trigger member and a switching member. The trigger member has a recess defined laterally. Two protrusions are defined in the inner wall of the recess. The switching member has an adjusting member and a trigger plate. Under this arrangement, when the adjusting member is pressed into the recess, the trigger plate is at one position to allow the trigger to shoot in a repeat shoot mode; when the adjusting member is turned to abut against the two protrusions, the trigger plate is at another position to allow the trigger to shoot in a one shoot mode.

10 Claims, 6 Drawing Sheets

TRIGGER STRUCTURE FOR SWITCHING ONE SHOOT MODE OR REPEAT SHOOT MODE

BACKGROUND OF THE INVENTION

1. Field of the Invention

The present invention relates to a trigger structure, more particularly to a trigger structure for switching one shoot mode or repeat shoot mode.

2. Description of Related Art

The conventional trigger structure is usually attached to a nail gun so that the nail gun has one shoot mode and repeat shoot mode for a user to operate. One shoot mode is only one triggering with one shoot. Repeat mode is holding trigger with several shoots. Thus, the user can choose one suitable mode in order to deal with their tasks conveniently.

However, a switch of the conventional trigger structure is often constructed by a switching lever rotating on a plate, like a needle rotating in a clock. The switching lever is often unexpectedly switched by the user during the busy work so that the user might be easy to get hurt by the nail gun at an unexpected shoot mode. In addition, some countries only allow those nail guns, in which the user must use two hands to switch and operate the nail gun, to import for sale.

The present invention has arisen to mitigate and/or obviate the disadvantages of the conventional.

SUMMARY OF THE INVENTION

The main objective of the present invention is to provide an improved trigger structure for switching one shoot mode or repeat shoot mode.

To achieve the objective, a trigger structure for switching one shoot mode or repeat shoot mode comprises a trigger member, a top of the trigger member pivoted on a nail gun, a receiving space defined in the trigger member and extending to a bottom of the trigger member, a recess laterally defined on the trigger member, the trigger member having a first pivotal hole defined laterally and opposed to the recess, the trigger member having a second pivotal hole defined therethrough, the first pivotal hole and the second pivotal hole communicated with the receiving space, two protrusions extended from two opposite inner corners of the recess, a switching member assembled into the receiving space, the switching member further comprising:

a pivotal member having two pivotal portions at one end thereof, a connecting hole defined at another end of the pivotal member and corresponding to the first pivotal hole, an adjusting member being assembled to the trigger member by passing through the recess, the first pivotal hole and the connecting hole, a spring placed on the adjusting member and located between the pivotal member and the trigger member; and a trigger plate having a pivotal protrusion which is received between the two pivotal portions, a fixing rod passing through the second pivotal hole, the two pivotal portions and the pivotal protrusion; thereby when the adjusting member is received into the recess, the trigger plate is at a first position so that the trigger structure is under the repeat shoot mode; when the adjusting member is pushed from the first pivotal hole to the recess, the adjusting member is moved out of the recess and the adjusting member drives the pivotal member and the trigger plate to axially move along the fixing rod simultaneously; thereafter the user uses another hand to rotate the adjusting member until the adjusting member is above the two protrusions; after the spring is recovering, the adjusting member is abutted against the two protrusions and the trigger plate is also positioned at a second position so that the trigger structure is under the one shoot mode.

An annular groove is defined around the connecting hole on the pivotal member, the spring being resisted against the annular groove.

The adjusting member has a first cylindrical rod, one end of the first cylindrical rod corresponding to the recess, another end of the first cylindrical rod connected to a head portion, the head portion further comprising a round portion and two tip portions, the two tip portions extended from the round portion along a diameter of the round portion.

Two protrusions are extended from two opposite inner corners of the recess, the protrusion formed as a round corner so that the two tip portions are abutted against the two protrusions when the trigger structure is under one shoot mode.

A fixing member is assembled to the one end of the first cylindrical rod, the fixing member having a second cylindrical rod and a third cylindrical rod, the diameter of the second cylindrical rod smaller than the diameter of the first pivotal hole, the diameter of the second cylindrical rod larger than the diameter of the third cylindrical rod and the diameter of the connecting hole.

The diameter of the fixing rod is smaller than the diameter of the first cylindrical rod.

When the user uses one hand to press the fixing member for making the head portion of the adjusting member move out of the recess and the user uses another hand to rotate the head portion for making the tip portions of the head portion lock above the recess, the trigger plate is positioned at a third position so that the trigger structure cannot be shot and the trigger structure is under a safe mode.

The receiving space of the trigger member has a first room for receiving the movable trigger plate and a second room for receiving the pivotal member, the adjusting member and the spring, the first room larger than the second room, the second room communicated with the first room.

Three marks are labeled on the trigger member near the recess, the marks labeling one shoot mode, repeat shoot mode and safe mode for the user to correctly switch the trigger structure.

The fixing rod passing through the second pivotal hole is parallel to the adjusting member.

Further benefits and advantages of the present invention will become apparent after a careful reading of the detailed description with appropriate reference to the accompanying drawings.

DETAILED DESCRIPTION OF THE INVENTION

Figure 1:
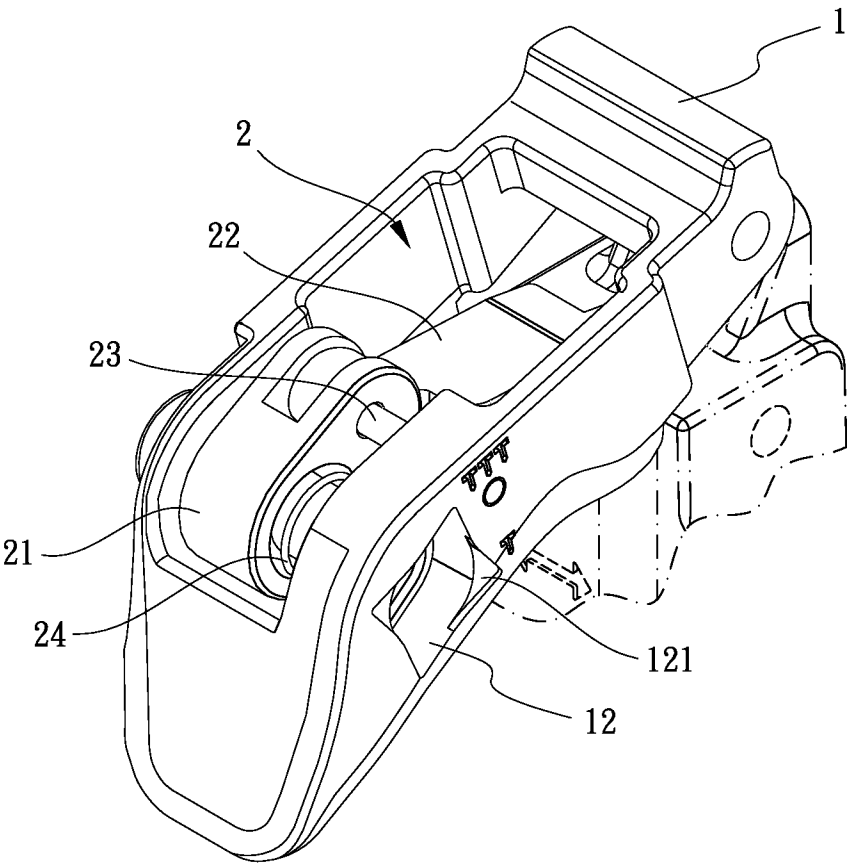
FIG. 1 is an assembled view of a trigger structure for switching one shoot mode or repeat shoot mode in accordance with the present invention.

Referring to FIGS. 1-4, a trigger structure for switching one shoot mode or repeat shoot mode in accordance with the present invention comprises a trigger member 1 and a switching member 2. A top of the trigger member 1 is pivoted on a nail gun 3. A receiving space 11 is defined in the trigger member 1 and extending to a bottom of the trigger member 1. A recess 12 is laterally defined on the trigger member 1. The trigger member 1 has a first pivotal hole 13 defined laterally and opposed to the recess 12. The trigger member 1 has a second pivotal hole 14 defined therethrough. The first pivotal hole 13 and the second pivotal hole 14 are communicated with the receiving space 11. Two protrusions 121 are extended from two opposite inner corners of the recess 12. The protrusion 121 is formed as a round corner.

The switching member 2 is assembled into the receiving space 11. The switching member 2 comprises a pivotal member 21, a trigger plate 22, a fixing rod 23, a spring 24 and an adjusting member 25. The pivotal member 21 has two pivotal portions 211 at one end thereof. A connecting hole 212 is defined at another end of the pivotal member 21 and corresponding to the first pivotal hole 13. An annular groove 213 is defined around the connecting hole 212 on the pivotal member 21. The adjusting member 25 has a first cylindrical rod 251. One end of the first cylindrical rod 251 is corresponding to the recess 12. Another end of the first cylindrical rod 251 is connected to a head portion 252. The head portion 252 further comprises a round portion 2522 and two tip portions 2521. The two tip portions 2521 are extended from the round portion 2522 along a diameter of the round portion 2522. The trigger plate 22 has a pivotal protrusion 221 which is received between the two pivotal portions 211. The fixing rod 23 passes through the second pivotal hole 14, the two pivotal portions 211 and the pivotal protrusion 221. The diameter of the fixing rod 23 is smaller than the diameter of the first cylindrical rod 251. When the head portion 252 is received into the recess 12, the trigger structure is under a repeat shoot mode. The adjusting member 25 is assembled to the trigger member 1 by passing through the recess 12, the first pivotal hole 13 and the connecting hole 212. The spring 24 is placed on the adjusting member 25 and located between the pivotal member 21 and the trigger member 1. The spring 24 is resisted against the annular groove 213.

Figure 8:
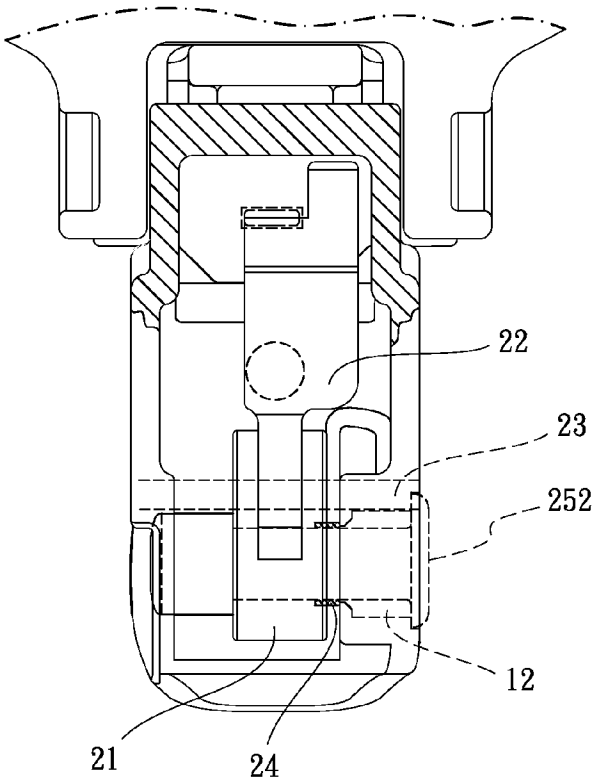
FIG. 8 is a top side view of the FIG. 7 and the broken line describes those elements covered by the trigger element.
Figure 7:
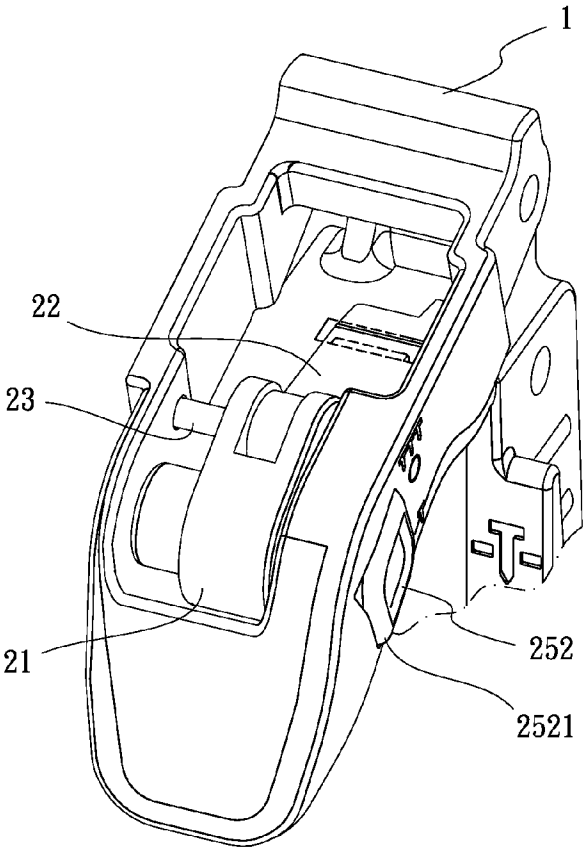
FIG. 7 is a perspective view for showing the trigger structure under one shoot mode.

When the adjusting member 25 is received into the recess 12, the trigger plate 22 is pushed by a switching rod of the nail gun 3 to a first position so that the trigger plate 22 can sequentially trigger the switching rod and the trigger structure is under the repeat shoot mode as shown in FIGS. 3-6. On the other hand, when the adjusting member 25 is pushed from the first pivotal hole 13 to the recess 12 by one hand of a user, the head portion 252 is moved out of the recess 12. At the same time, the adjusting member 25 drives the pivotal member 21 and the trigger plate 22 to axially move along the fixing rod 23. Thereafter, the user uses another hand to rotate the adjusting member 25 until the two tip portions 2521 are respectively above the two protrusions 121. After the spring 24 is recovering, the two tip portions 2521 of the adjusting member 25 is abutted against the two protrusions 121 and the trigger plate 22 is also positioned at a second position so that the trigger plate 22 cannot sequentially trigger the switching rod and the trigger structure is under the one shoot mode as shown in FIGS. 7-8. As mentioned above, when the users want to switch the trigger structure from repeat shoot mode to one shoot mode, they must use their two hands to operate. Thus, the present invention can prevent the switch from triggering unexpectedly.

Referring to FIGS. 2, 5-8, a fixing member 26 is assembled to the one end of the first cylindrical rod 251. The fixing member 26 has a second cylindrical rod 261 and a third cylindrical rod 262. The diameter of the second cylindrical rod 261 is smaller than the diameter of the first pivotal hole 13. The diameter of the second cylindrical rod 261 is larger than the diameter of the third cylindrical rod 262 and the diameter of the connecting hole 212. When the user presses the fixing member 26, the head portion 252 of the adjusting member 25 is moved out of the recess 12. Thereafter, the user rotates the head portion 252 to make the head portion 252 move into the recess 12 or to make the head portion 252 abut against the protrusions 121 for switching repeat shoot mode or one shoot mode.

Figure 10:
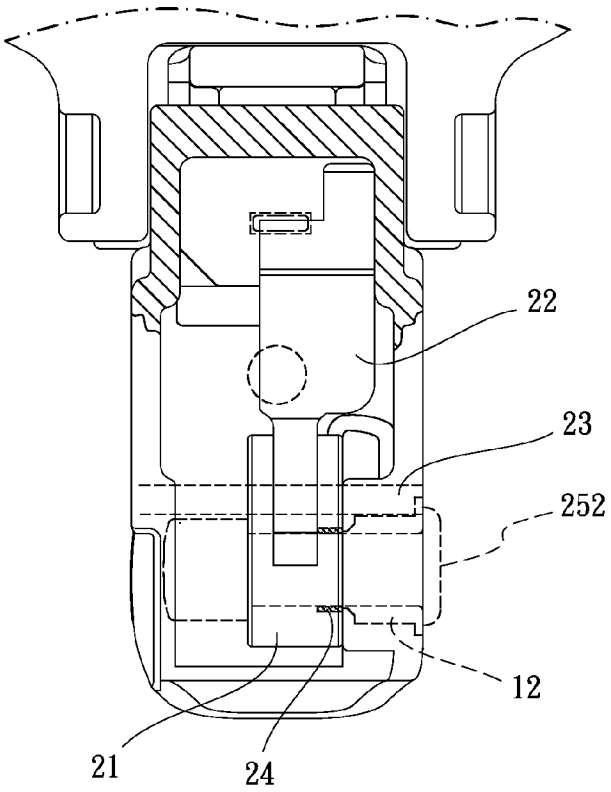
FIG. 10 is a top side view of the FIG. 9 and the broken line describes those elements covered by the trigger element.
Figure 9:
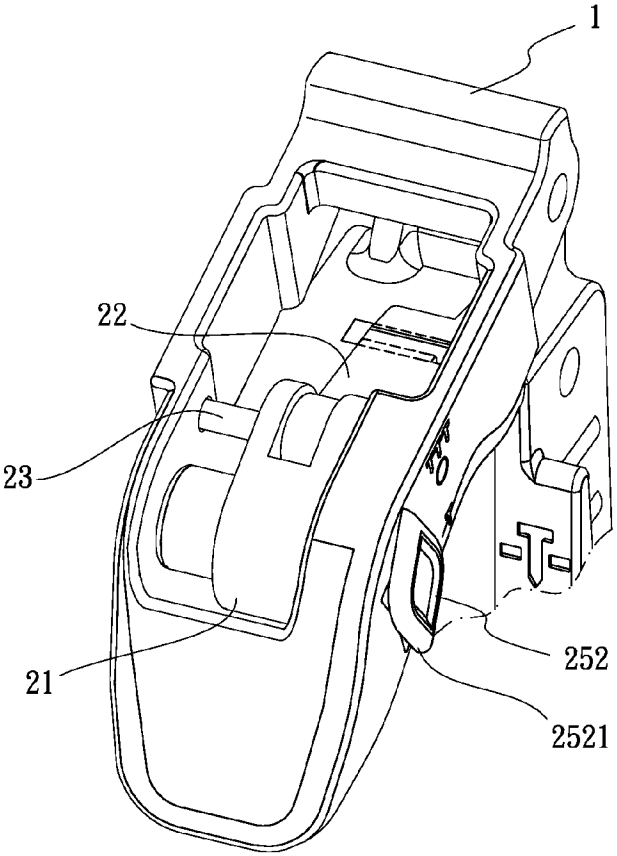
FIG. 9 is a perspective view for showing the trigger structure under safe mode.

Referring to FIGS. 9-10, when the user uses one hand to press the fixing member 26 for making the head portion 252 of the adjusting member 25 move out of the recess 12 and the user uses another hand to rotate the head portion 252 for making the tip portions 2521 of the head portion 252 lock above the recess 12, the trigger plate 22 is positioned at a third position so that the trigger structure cannot be shot and the trigger structure is under a safe mode.

Figure 2:
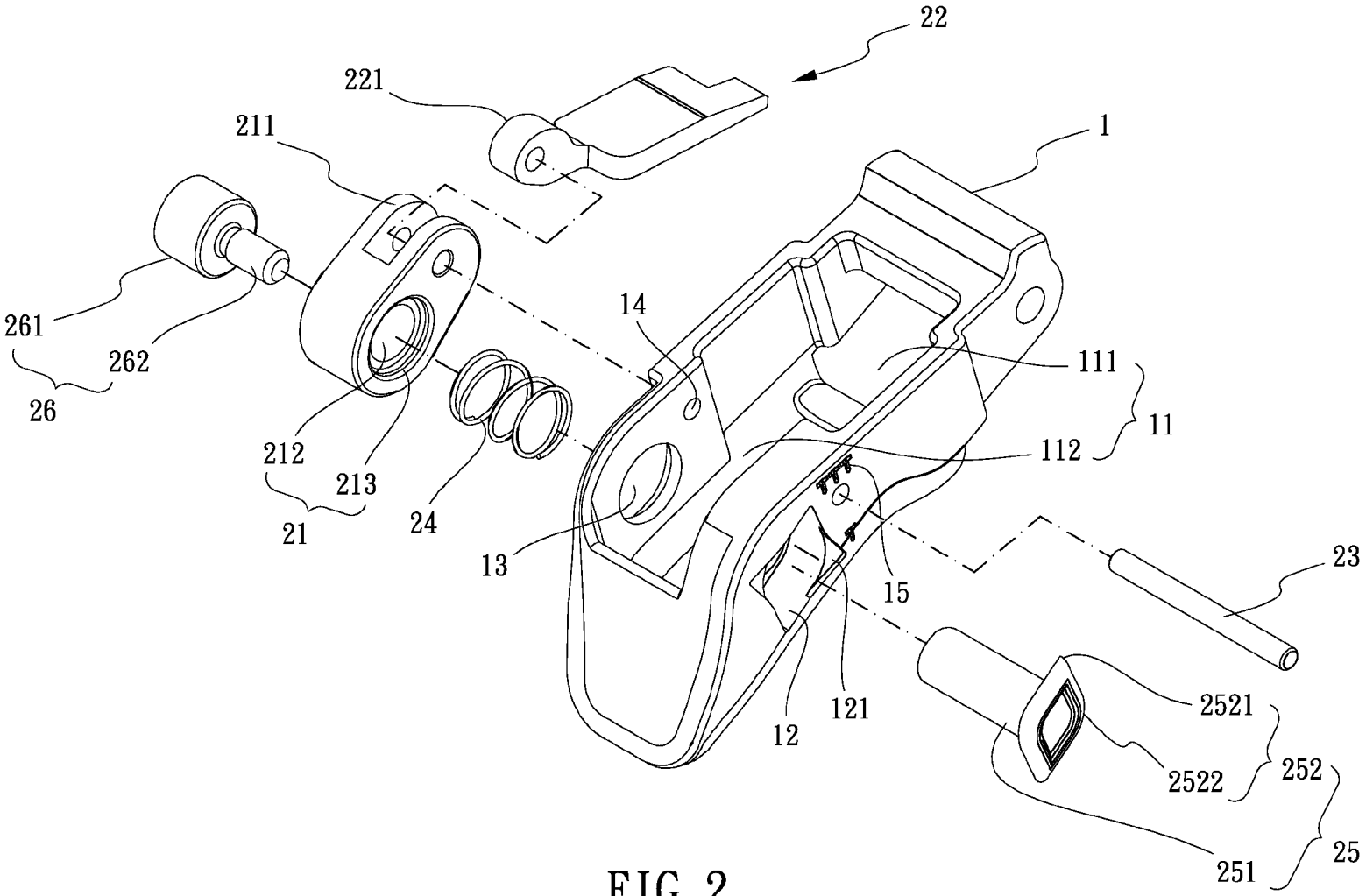
FIG. 2 is an exploded view of the trigger structure for switching one shoot mode or repeat shoot mode in accordance with the present invention.
Figures 3, 4:
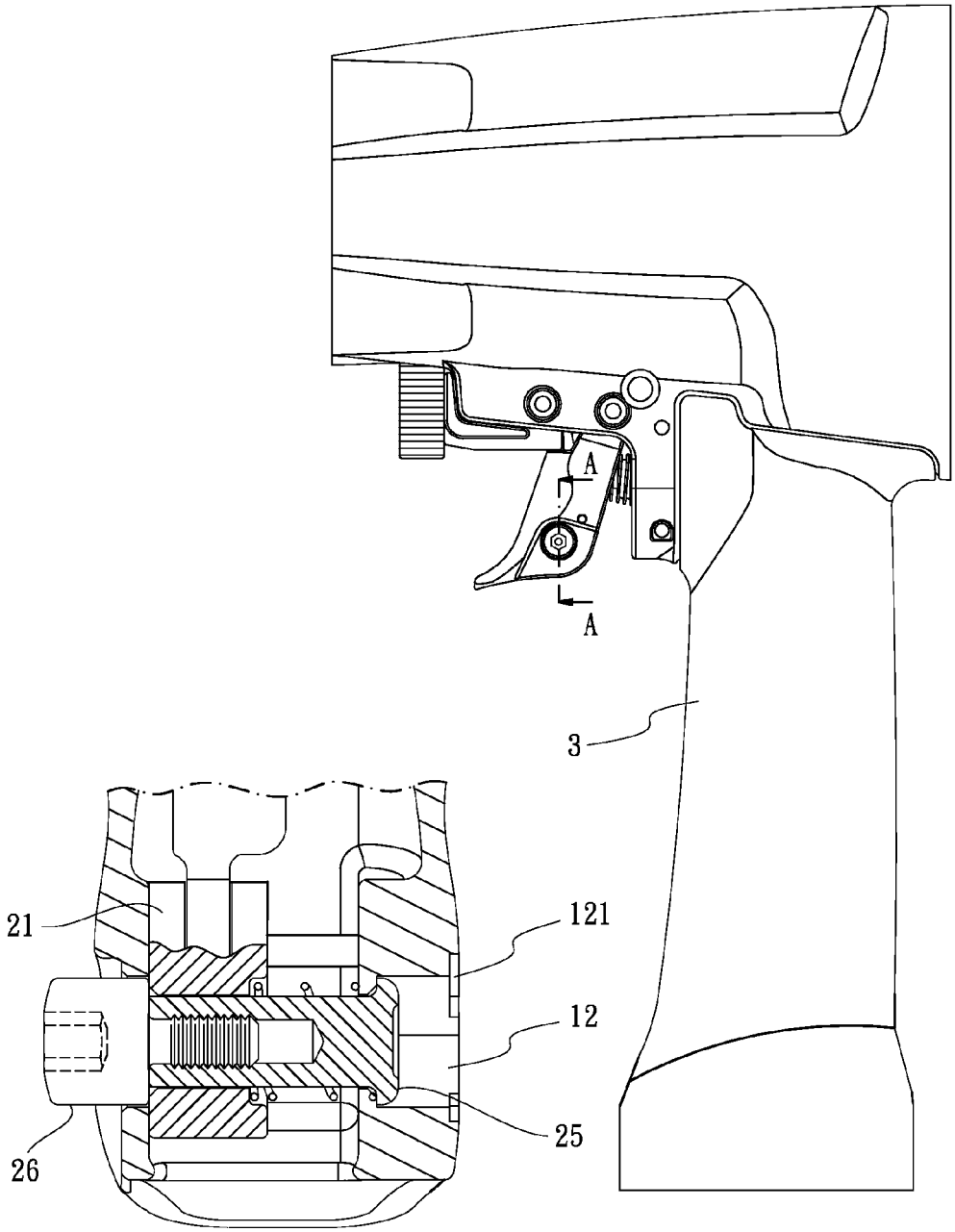
FIG. 3 is an assembled view for showing the trigger structure assembled to a nail gun.
FIG. 4 is a cross-sectional view of the FIG. 3 along a line AA in the FIG. 3.
Figure 6:
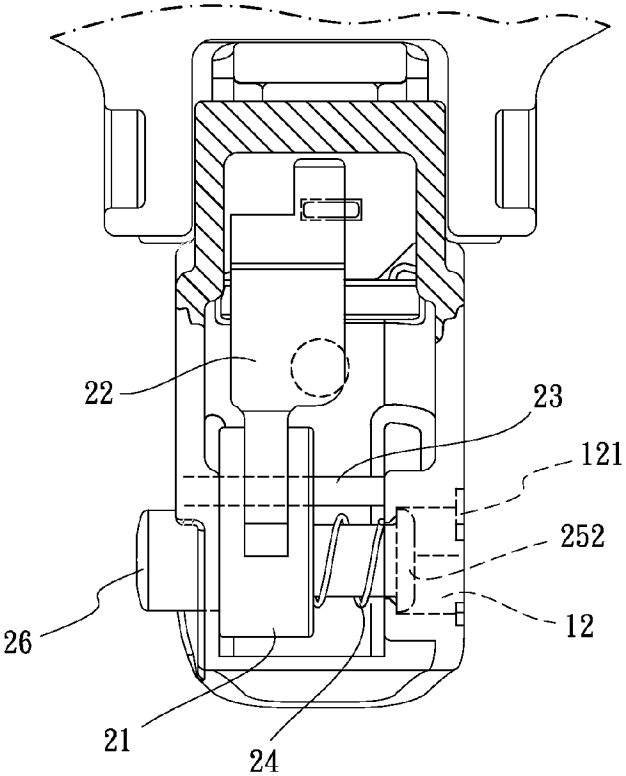
FIG. 6 is a top side view of the FIG. 5 and the broken line describes those elements covered by a trigger element.
Figure 5:
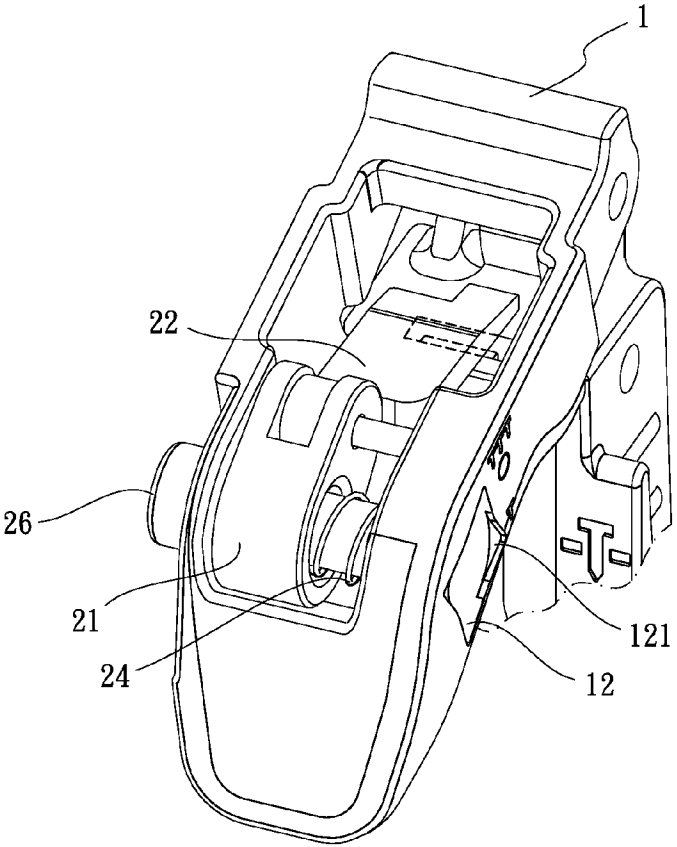
FIG. 5 is a perspective view for showing the trigger structure under repeat shoot mode.

Referring to FIG. 2, the receiving space 11 of the trigger member 1 has a first room 111 for receiving the movable trigger plate 22 and a second room 112 for receiving the pivotal member 21, the adjusting member 25 and the spring 24. The first room 111 is larger than the second room 112. The second room 112 is communicated with the first room 111. The fixing rod 23 passing through the second pivotal hole 14 is parallel to the adjusting member 25. The recess 12 is communicated with the second room 112. Three marks 15 are labeled on the trigger member 1 near the recess 12. The marks 15 label one shoot mode, repeat shoot mode and safe mode for the user to correctly switch the trigger structure.

Although the invention has been explained in relation to its preferred embodiment, it is to be understood that many other possible modifications and variations can be made without departing from the spirit and scope of the invention as hereinafter claimed.

What is claimed is:

1. A trigger structure for switching one shoot mode or repeat shoot mode comprising:

a trigger member, a top of the trigger member pivoted on a nail gun, a receiving space defined in the trigger member and extending to a bottom of the trigger member, a recess laterally defined on the trigger member, the trigger member having a first pivotal hole defined laterally and opposed to the recess, the trigger member having a second pivotal hole defined therethrough, the first pivotal hole and the second pivotal hole communicated with the receiving space, two protrusions extended from two opposite inner corners of the recess; and a switching member assembled into the receiving space, the switching member further comprising:

a pivotal member having two pivotal portions at one end thereof, a connecting hole defined at another end of the pivotal member and corresponding to the first pivotal hole;

an adjusting member being assembled to the trigger member by passing through the recess, the first pivotal hole and the connecting hole, a spring placed on the adjusting member and located between the pivotal member and the trigger member; and a trigger plate having a pivotal protrusion which is received between the two pivotal portions, a fixing rod passing through the second pivotal hole, the two pivotal portions and the pivotal protrusion;

thereby when the adjusting member is received into the recess, the trigger plate is at a first position so that the trigger structure is under the repeat shoot mode; when the adjusting member is pushed from the first pivotal hole to the recess, the adjusting member is moved out of the recess and the adjusting member drives the pivotal member and the trigger plate to axially move along the fixing rod simultaneously; thereafter the adjusting member is rotated until the adjusting member is above the two protrusions; after the spring is recovering, the adjusting member is abutted against the two protrusions and the trigger plate is also positioned at a second position so that the trigger structure is under the one shoot mode.

2. The trigger structure for switching one shoot mode or repeat shoot mode as claimed in claim 1, wherein an annular groove is defined around the connecting hole on the pivotal member, the spring being resisted against the annular groove.

3. The trigger structure for switching one shoot mode or repeat shoot mode as claimed in claim 1, wherein the adjusting member has a first cylindrical rod, one end of the first cylindrical rod corresponding to the recess, another end of the first cylindrical rod connected to a head portion, the head portion further comprising a round portion and two tip portions, the two tip portions extended from the round portion along a diameter of the round portion.

4. The trigger structure for switching one shoot mode or repeat shoot mode as claimed in claim 3, wherein two protrusions are extended from two opposite inner corners of the recess, the protrusion formed as a round corner so that the two tip portions are abutted against the two protrusions when the trigger structure is under one shoot mode.

5. The trigger structure for switching one shoot mode or repeat shoot mode as claimed in claim 3, wherein a fixing member is assembled to the one end of the first cylindrical rod, the fixing member having a second cylindrical rod and a third cylindrical rod, the diameter of the second cylindrical rod smaller than the diameter of the first pivotal hole, the diameter of the second cylindrical rod larger than the diameter of the third cylindrical rod and the diameter of the connecting hole.

6. The trigger structure for switching one shoot mode or repeat shoot mode as claimed in claim 3, wherein the diameter of the fixing rod is smaller than the diameter of the first cylindrical rod.

7. The trigger structure for switching one shoot mode or repeat shoot mode as claimed in claim 3, wherein the fixing member is pressed to make the head portion of the adjusting member move out of the recess and the head portion is rotated to make the tip portions of the head portion lock above the recess, the trigger plate is positioned at a third position so that the trigger structure cannot be shot and the trigger structure is under a safe mode.

8. The trigger structure for switching one shoot mode or repeat shoot mode as claimed in claim 1, wherein the receiving space of the trigger member has a first room for receiving the movable trigger plate and a second room for receiving the pivotal member, the adjusting member and the spring, the first room larger than the second room, the second room communicated with the first room.

9. The trigger structure for switching one shoot mode or repeat shoot mode as claimed in claim 1, wherein three marks are labeled on the trigger member near the recess, the marks labeling one shoot mode, repeat shoot mode and safe mode for correctly switching the trigger structure.

10. The trigger structure for switching one shoot mode or repeat shoot mode as claimed in claim 1, wherein the fixing rod passing through the second pivotal hole is parallel to the adjusting member.

* * * * *